US005589740A

United States Patent [19]

Rudolph et al.

[11] Patent Number: 5,589,740

[45] Date of Patent: Dec. 31, 1996

[54] SEMICONDUCTOR-CONTROLLED OPERATING CIRCUIT FOR ONE OR MORE LOW-PRESSURE DISCHARGE LAMPS, TYPICALLY FLUORESCENT LAMPS

[75] Inventors: Bernd Rudolph; Alwin Veser, both of Munich, Germany

[73] Assignee: Patent-Treuhand-Gesellschaft F. Elektrische Gluehlampen mbH, Munich, Germany

[21] Appl. No.: 495,803

[22] Filed: Jun. 27, 1995

[30] Foreign Application Priority Data

Jul. 21, 1994 [DE] Germany ..... 44 25 859.3

[51] Int. Cl.[6] ..... H05B 37/02

[52] U.S. Cl. ..... 315/291; 315/106; 315/107; 315/225

[58] Field of Search ..... 315/94, 100, 101, 315/105, 106, 107, 224, 225, 244, 291, DIG. 7

[56] References Cited

U.S. PATENT DOCUMENTS

| | | | |
|---|---|---|---|
| 4,251,752 | 2/1981 | Stolz | 315/206 |
| 4,808,887 | 2/1989 | Fahnrich et al. | 315/247 |
| 5,027,033 | 6/1991 | Zuchtriegel | 315/106 |
| 5,434,477 | 7/1995 | Crouse et al. | 315/209 R |

FOREIGN PATENT DOCUMENTS

0276460B1 8/1988 European Pat. Off. .

*Primary Examiner*—Robert Pascal
*Assistant Examiner*—David H. Vu
*Attorney, Agent, or Firm*—Frishauf, Holtz, Goodman, Lancer & Chick, P.C.

[57] ABSTRACT

To operate one or more serially connected low-pressure discharge lamps, typically fluorescent lamps, a preheating circuit is provided to preheat the electrodes of the lamps (E1, E2, E3, E4), which changes from low-impedance to high-impedance state after the lamps have been preheated by controlling a semiconductor switch (Q3) in the heating circuit. In accordance with the invention, to eliminate reliance on the resistances of the lamp filaments themselves, which are subject to variation from lamp-to-lamp due to manufacturing tolerances, and later on, to changes due to aging of the lamp, and to provide for reliable switching of the semiconductor switch, a sensing impedance element (Z), which may be an ohmic resistor or a capacitor (Z', Z"), is serially connected to the switching path of the semiconductor switch (Q3) which, typically, is a field effect transistor (FET). The voltage drop across the series circuit formed by the impedance element (Z, Z', Z") and the semiconductor switch (Q3) is set by suitable dimensioning of the impedance element, to be sufficient to retain the main switching path of the semiconductor switch in low-impedance state when it carries full heater current, that is, is already in low-impedance state. To change over to high-impedance state, control signals to the semiconductor switch are removed, for example by shunting a resistor (R2) in a voltage divider, thus turning the semiconductor switch (Q3) OFF.

16 Claims, 3 Drawing Sheets

SEMICONDUCTOR-CONTROLLED OPERATING CIRCUIT FOR ONE OR MORE LOW-PRESSURE DISCHARGE LAMPS, TYPICALLY FLUORESCENT LAMPS

Reference to related patents and applications, the disclosures of which are hereby incorporated by reference: U.S. Pat. No. 4,808,887, Fähnrich et al., assigned to the assignee of the present application; application Ser. No. 08/508,341, filed Jul. 27, 1995, Continuation of U.S. Ser. No. 08/246,738, filed May 20, 1994, Rudolph, abandoned, assigned to the assignee of the present application, published as International Application W092/12631. Reference to related publication, assigned to the assignee of the present application: European Patent 0 276 460 B1, Fähnrich et al., Reference to related publication: "Elektronik-schaltungen" ("Electronic Networks"), published by Siemens AG, pages 147–148.

FIELD OF THE INVENTION

The present invention relates to an operating circuit for one or more low-pressure discharge lamps, typically fluorescent lamps, which are controlled by a semiconductor switch.

BACKGROUND

Semiconductor operating circuits for low-pressure discharge lamps, typically fluorescent lamps, when operated from network voltages, typically utilize a rectifier which rectifies alternating current energy, applied through a power network. The supplied d-c is then converted to a-c in an inverter circuit, for example a push-pull half-bridge circuit as well known in the art, to provide output energy at an elevated frequency, for example between about 10–50 kHz. A resonance circuit is coupled to the inverter. The resonance circuit includes at least a resonance inductance and a resonance capacity, for example one or more capacitors. The discharge lamps have electrodes which can be heated, and at least one heater circuit is coupled to the heatable electrodes for preheating the electrodes. A semiconductor switch having its main switching path is connected in the heater circuit and, in dependence on the switched state of the semiconductor switch, the heating circuit is switched between a low-resistance and a high-resistance state. Circuits of this type are described, for example, in the referenced copending application Ser. No. 08/508,341, filed Jul. 27, 1995, Continuation of U.S. Ser. No. 08/246,738, filed May 20, 1994, Rudolph, abandoned, assigned to the assignee of the present application.

This circuit includes an inverter with a resonance circuit to operate one or more low-pressure discharge lamps having heatable electrodes. The preheating phase of the electrodes, for example electrode filaments, is terminated by a relay, or by a semiconductor switch. The relay or the switch, respectively, receive a control signal from either a voltage sensing circuit sensing a specific threshold voltage, or from a timing circuit. During the heating phase, the voltage drop across the electrode filaments of the lamp is evaluated.

When making the electrode filament, it is unavoidable that some tolerances in resistance values of the filaments result. Comparatively wide ranges of tolerances of the resistances of the filaments may arise. Even electrodes of the same type may have voltages which differ from each other across their respective electrode filaments. These variations in voltages can lead to erroneous operation; some low-pressure discharge lamps whose electrodes are comparatively cold may not be sufficiently preheated and already fire or cold-start. Furthermore, long connecting lines to the lamps can cause insufficient preheating of the electrode filaments. With long connecting lines, connecting lamps or lamp fittings or sockets to the pre-heating circuit, it is possible that even low-voltage electrode filaments simulate the impedance of warm lamp electrodes, since the impedance or resistance of the connecting lines is added to the resistance of the electrode filaments themselves. The threshold or sensing voltages are derived not from the fittings for the lamps themselves but, rather, from the remote ends of the connecting lines to the operating circuit, sometimes referred to as a ballast.

THE INVENTION

It is an object to provide an operating circuit to operate one or more low-pressure discharge lamps, typically fluorescent lamps, which ensures adequate preheating of the filaments, while using only simple circuitry.

Briefly, the circuit above-referred to is improved by connecting at least one impedance element in at least one heater circuit to the lamps, in series with the main switching path of the semiconductor switch; and providing a control connection between that impedance element and the control terminal of the semiconductor switch for controlling the operation of the semiconductor switch in accordance with the voltage drop across the impedance element. Thus, the impedance element and main switching path combination provides the sensing or threshold voltage which, when the semiconductor switch is in low-resistant state, controls the switch to remain in low-resistant state until the voltage drop across this additional sensing resistor changes as the filament heats. Upon such change, the semiconductor switch changes its resistance, and thus the current flow through the series circuit including the sensing is impeded.

The circuit is particularly suitable for an arrangement which includes an inverter with a series resonance circuit coupled thereto, which operates at least one low-pressure discharge lamp with preheatable electrodes. The lamp electrodes are integrated in one or more heater circuits. At least one of the heater circuits includes the semiconductor switch which changes the impedance of the heater circuit over its main switching path directly. If other heater circuits are to be changed over, transformer coupling can be used. At the termination of the electrode preheating phase, the switching path is changed from low impedance to high impedance state.

In accordance with a feature of the invention, the impedance value of the impedance element connected in series to the main switching path of the semiconductor switch is so selected that the voltage drop across the impedance element, in combination with the impedance of the semiconductor switch, when in low resistance state, is sufficient to provide a control signal which is coupled to the semiconductor switch, so that the semiconductor switch will be in its low impedance state. Thus, the entire series circuit of impedance element and semiconductor main switching path will be of low impedance value. The semiconductor switch, due to the voltage loading upon firing of the low-pressure discharge lamp, suitably is connected in a d-c path of a bridge rectifier. This is not a necessary feature, however, since the semiconductor switch can be included directly in the heater circuit, without an additional rectifier. The resistance element can be integrated in the direct current, or an alternating current network of the bridge rectifier.

A timing circuit establishes a time interval for the preheating phase; after elapse of the time determined by the timing circuit, the control signal is removed and the semiconductor switch assumes a high impedance state, which results in a high impedance path to the filement so that, when the lamp fires, the electrodes are appropriately preheated.

The semiconductor switch, preferably, is a field effect transistor (FET), and the impedance element may be either an ohmic resistor or a capacitor, which, respectively, is connected in series to the drain-source path of the FET. The impedance of the impedance element is so selected that the voltage drop across the series circuit formed by the impedance element and the drain-source path, when in low impedance state, is about 10 V. This ensures that when the circuit, or the lamps, respectively is turned ON, the FET will reliably change to its low impedance state, thus preventing cold-starting of the low-pressure discharge lamp or lamps. It is a particular advantage of the circuit that it can be used with a plurality of serially connected discharge lamps, since it is inexpensive and has low losses.

DRAWINGS

DETAILED DESCRIPTION

Figure 1:
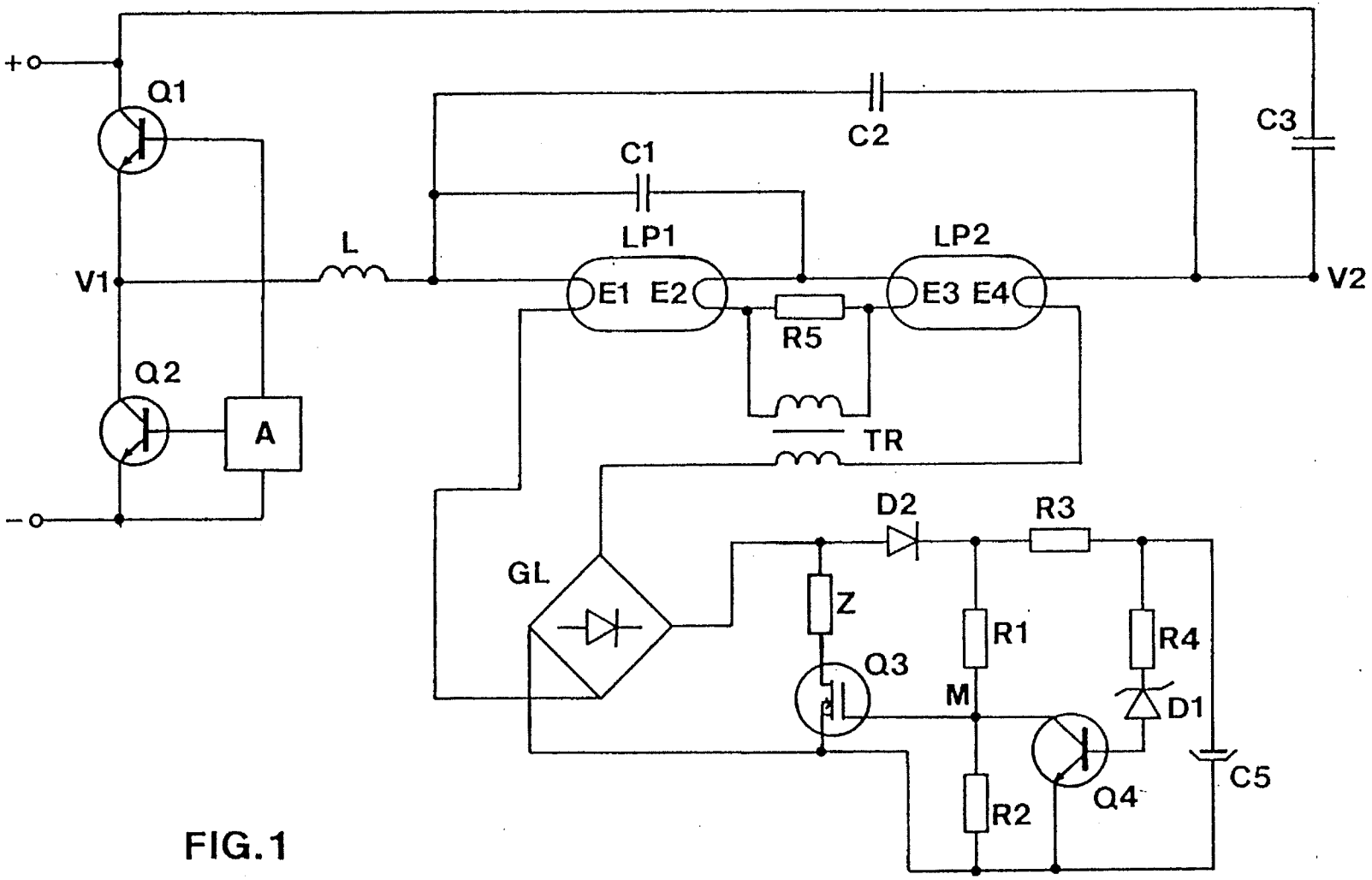
FIG. 1 is a basic schematic circuit of a first embodiment of the invention, illustrating operation of the circuit to control two serially connected low-pressure discharge lamps.

Referring first to FIG. 1:

The circuit has an inverter formed of two switching transistors Q1, Q2, connected to a source of direct current energy, for example the output from a rectifier coupled to an a-c power network. A control circuit A, as well known in the art, and see for example the referenced U.S. Pat. No. 4,808,887, Fähnrich et al, is connected to the switching transistors Q1, Q2. The center connection or center tap V1 of the inverter formed by the transistors Q1, Q2 and the control unit A is connected to a series resonance circuit, which has a resonance inductance L and a resonance capacitor C2 and to two serially connected low-pressure discharge lamps LP1, LP2. Each of the lamps has a rating of 58 W, respectively. A starting capacitor C1, for sequential starting, is connected in parallel to the lamp LP1. The resonance capacitor C2 is connected in parallel to the series circuit of the two lamps LP1, LP2. Capacitor C2 as well as the network including the two lamps are connected in series with the inductance L. A coupling capacitor C3, connected to the positive terminal of the d-c source, closes the a-c circuit. Two heater circuits to preheat the lamp electrode filaments E1, E2 and E3 and E4 are further provided.

The first heater circuit includes the electrode filaments E1, E4, the bridge rectifier GL and the primary winding of a transformer TR. In accordance with a feature of the invention, a control or sensing impedance Z and the drain-source path of the FET Q3 are serially included in the first heater circuit. The impedance Z, as shown, is an ohmic resistor. The heater circuit heats the lamp electrodes E1 and E4. The ohmic resistor Z and the drain-source path are serially connected between the d-c terminals of the bridge rectifier GL. When the heater circuit including the FET Q3 is in low-resistance state, electrode heater current flows through the ohmic resistor, the drain-source path or FET Q3 and the bridge rectifier.

To obtain a control voltage for the FET Q3, a voltage divider R1, R2 is connected in parallel to the series circuit formed by the resistor Z and the drain-source path of the FET Q3. The center tap or terminal M is connected to the gate electrode of the FET Q3 and to the collector of a bi-polar transistor Q4. The collector-emitter path of transistor Q4 is connected in parallel to the resistance R2 of the voltage divider. An R/C circuit formed by resistor R3 and capacitor C5 is connected parallel to the voltage divider R1, R2. The time constant of the RC circuit can control the duration of the preheating phase.

The duration of the preheating phase, in this embodiment, does not depend on the temperature-dependent course of the resistance of the electrode filaments. The base-emitter path of the transistor Q4, together with the base resistor R4 and Zener diode D1, is connected in parallel to the capacitor C5 of the R/C network. A rectifier diode D2 connected between the resistor Z and the resistor R1 prevents flow of discharge current of the capacitor C5 through the switching path of FET Q3.

The second heating circuit for the electrodes E2, E3 is coupled to the first heating circuit above-described by the secondary winding of transformer TR. A resistor R5 is connected in parallel to the transformer TR.

Operation, with reference to FIG. 1:

Upon energizing the circuit, or turning it ON, inverter Q1, Q2, and A will provide a high-frequency a-c voltage between the terminals V1 and V2. A typical frequency is about 50 kHz. FET Q3 is turned ON via the voltage divider R1, R2. The resistance of the impedance, here resistor Z, ensures that the FET, when in low impedance state, receives a sufficiently high d-c voltage from the voltage divider R1, R2 to control the gate electrode over the resistor R2, so that high-frequency heater current can flow through the lamp electrodes E1, E4. A typical d-c voltage is about 10 V on the voltage divider formed by resistors R1, R2. Transformer TR receives heater current for the second heater circuit for the lamp electrodes E2, E3 by induction.

During the preheating phase, capacitor C5 will be charged through the resistor R3. When the voltage on capacitor C5 exceeds a critical value, Zener diode D1 becomes conductive and switches bi-polar transistor Q4 to low-resistance state. The now conductive collector-emitter path of the transistor Q4 bridges the resistor R2, so that the gate electrode of FET Q3 will no longer have sufficient control signal. Its drain-source path, and thus the first heater circuit, will become a high-impedance circuit. Due to the transformer coupling by transformer TR, the second heater circuit likewise is blocked.

This terminates the electrode preheating phase. Resonance capacitor C2 will build up the required firing or ignition voltage for the discharge lamps LP1, LP2.

The capacitor C5 will charge after ignition of the lamps LP1, LP2 over the operating voltage of the lamp to a d-c voltage which, over resistor R4 and Zener diode D1, is sufficient to ensure switch-over of the transistor Q4 to low-resistance state, and thus blocking the FET Q3 during running operation of the lamp.

Details of the inverter Q1, Q2 and the control circuit A are well known, and reference is made to the referenced U.S. Pat. No. 4,808,887, Fähnrich et al., as well as to the cited literature "Electronic Circuits" by Walter Hirschmann, published by Siemens AG, pages 147–148, as well as to the European Patent 0 276 460 B1, Fähnrich et al.

The Table, forming part of this specification, gives suitable values for the electrical components for two serially connected 58 W fluorescent lamps, connected in a circuit as described in connection with FIG. 1.

Figure 2:
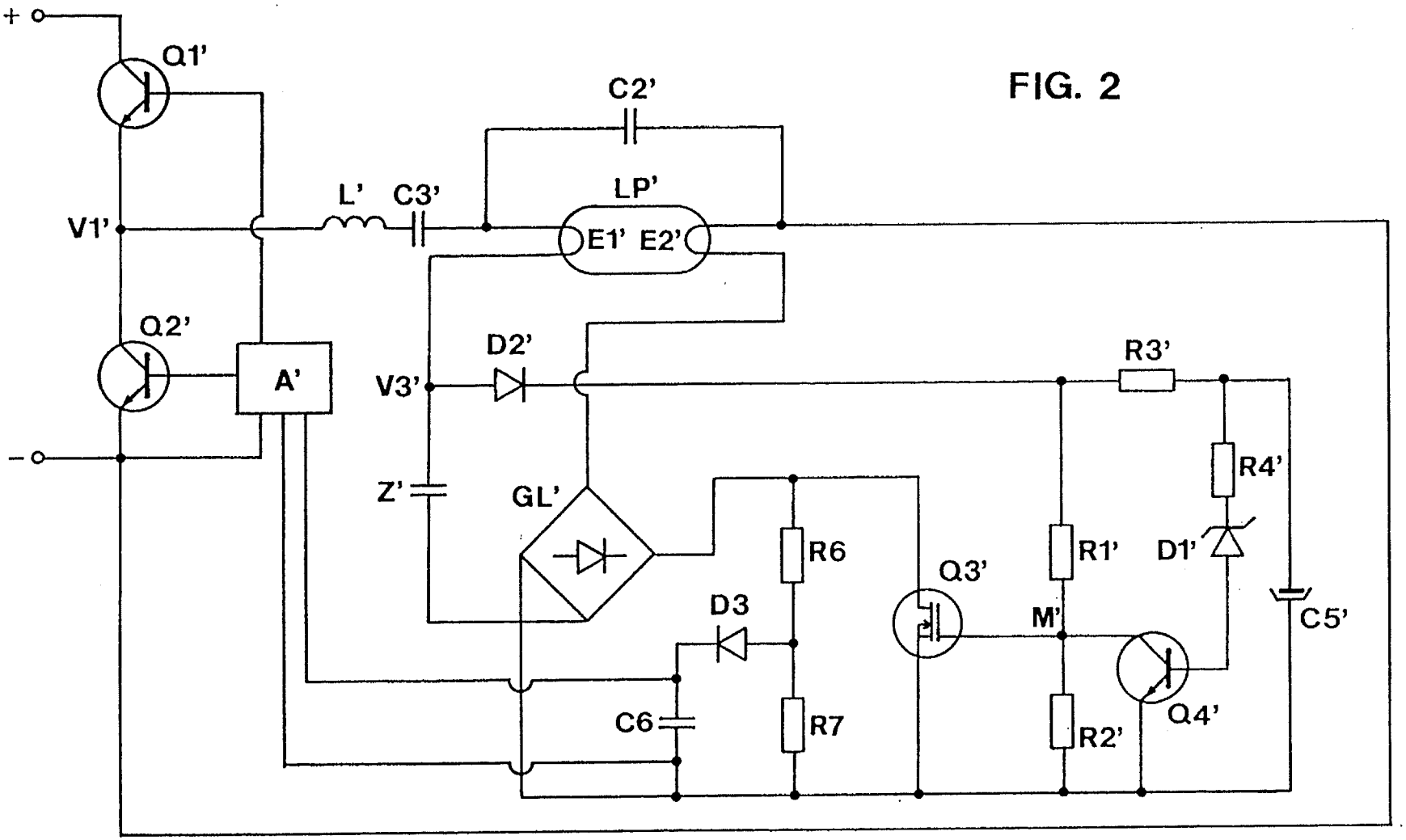
FIG. 2 is a circuit in accordance with a second embodiment to operate one low-pressure discharge lamp.

FIG. 2 illustrates another embodiment of the invention, in which elements having the same function and construction as in the embodiment in connection with FIG. 1 have been given the same reference designations, respectively with prime notation.

A d-c energy source supplies a half-bridge push-pull inverter having two switching transistor Q1', Q2' and a suitable control circuit A'. The center connection V1' of the inverter is coupled to a series resonance circuit having a resonance inductance in form of a lamp choke L', a coupling capacitor C3' and a resonance capacitor C2'. The resonance capacitor C2' is connected to the negative terminal of the d-c source. A low-pressure discharge lamp LP' typically a fluorescent lamp, is connected in parallel to the capacitor C2'. The lamp LP' has preheatable electrode filaments E1', E2'. Both lamp electrodes are integrated in a single electrode heater circuit.

In accordance with a feature of the invention, the heater circuit includes a sensing or control impedance, namely capacitor Z'. Capacitor Z' is connected to a bridge rectifier GL' and FET Q3'. The drain-source path of the FET Q3' is connected between the d-c terminals of the bridge rectifier GL'. The sensing or control impedance, here formed by capacitor Z', is connected in series to the a-c connections of the bridge rectifier GL', so that the capacitor Z' is in series with the drain-source path of FET Q3'. The FET Q3' is controlled over a rectifier diode D2' which is coupled to a junction or tap V3' in the heater circuit. Diode D2' is connected to a voltage divider formed by resistors R1', R2', the center terminal or tap M' of which is connected to the gate electrode of the FET Q3'. As described in connection with the first embodiment, an R/C circuit, formed by an ohmic resistor R3' and capacitor C5', is connected in parallel to the voltage divider R1', R2'. The circuit further includes a switching transistor Q4', the base connection of which is connected over a Zener diode D1' and a base resistor R4' both in parallel to the capacitor C5', to control the switching path of the switching transistor Q4'. The emitter of transistor Q4' is connected to the negative terminal of capacitor C5' and further to the bridge rectifier GL'. The collector of transistor Q4' is connected to the center terminal M' of the voltage divider R1', R2', and hence to the gate electrode of the FET Q3'.

In accordance with a feature of the invention, a lamp voltage monitoring element is provided, formed of a voltage divider R6, R7 connected in parallel to the drain-source path of the FET Q3', and a diode D3 serially connected with a capacitor C6. Connections taken from across the capacitor C6 are coupled to the control circuit A' for the inverter transistors Q1', Q2'.

Operation, embodiment of FIG. 2:

Basically the operation is similar to that previously described in connection with FIG. 1.

After energizing the circuit, the inverter Q1', Q2', A' provides an alternating current energy at high frequency, for example about 50 kHz. FET Q3' is turned ON over rectifier diode D2' and the voltage divider R', R2'. The impedance, here the capacitor Z', ensures that a sufficiently high voltage, for example 10 V, is available at the voltage divider R1', R2' when the FET Q3' is in low-resistance or low-impedance state. Thus, high-frequency heater current can flow through the lamp electrodes E1', E2'.

Differing from the first embodiment, however, in which the ohmic resistor Z was integrated in the direct current circuit of the bridge rectifier GL to ensure sufficient control voltage for the FET Q3, control voltage in this embodiment is obtained by means of the impedance of capacitor Z' in the a-c branch of the rectifier GL'.

During the preheating phase, capacitor C5' is charged over the rectifier diode D2' and the ohmic resistor R3'. When the voltage across capacitor C5 reaches a critical or threshold value, Zener diode D1' becomes conductive and switches through the bi-polar transistor Q4'. The now low impedance collector-emitter path of the transistor Q4' bridges the resistor R2' of the voltage divider R1', R2'. This withdraws control signal from the gate electrode of the FET Q3', so that its drain-source path, and consequently the heater circuit, becomes a high-impedance circuit. This terminates the electrode preheating phase. The requisite firing or arc-over voltage for the low-pressure discharge lamp will build up on the resonance capacitor C2'. The capacitor C5' will recharge after the lamp LP' has fired during the operating or running phase of the lamp in view of the running voltage of the lamp to a d-c voltage which ensures, over resistor R4' and Zener diode D1', that the transistor Q4' will reliably switch through, and thus block the FET, or cause it to have high-impedance state, while the lamp is in running condition.

The operating principle, so far disclosed, is practically identical with that described in connection with the embodiment illustrated in FIG. 1. In addition, however, FIG. 2 illustrates another feature. A lamp voltage monitoring circuit, formed by resistors R6, R7, diode D3 and capacitor C6, monitors the ignition and operating or running voltage of the low-pressure discharge lamp LP'. The voltage drop across capacitor C6 is evaluated by a turn-off circuit within the control circuit A'. Low-pressure discharge lamps, such as fluorescent lamps, in operation, change characteristics due to aging. For example, the ignition or firing voltage increases with age; furthermore, non-symmetries in the deterioration of the electrodes may change the characteristics of the lamp LP', for example due to burn-off of the electrodes. The result may be that, effectively, the lamp LP' operates under essentially d-c conditions. Capacitor C3 monitors a change in ignition or running voltage on the lamp LP', which change is then transmitted as a sensed voltage to the turn-off circuit within the control circuit A', for example by removing control voltages from the bases of the transistors Q1', Q2' by a circuit somewhat similar to that described in connection with the circuit including voltage divider R1', R2' and transistor Q4'. The turn-off circuit arrangement, typically, removes the base signal from the switching transistor Q1, Q2, or Q1', Q2', respectively, thus effectively shutting the inverter OFF. A turn-off circuit of this type, which is well known, is illustrated, for example in EP 0 276 460 B1, F ähnrich et al, Great Britain nominated, and translation into English filed.

Figure 3:
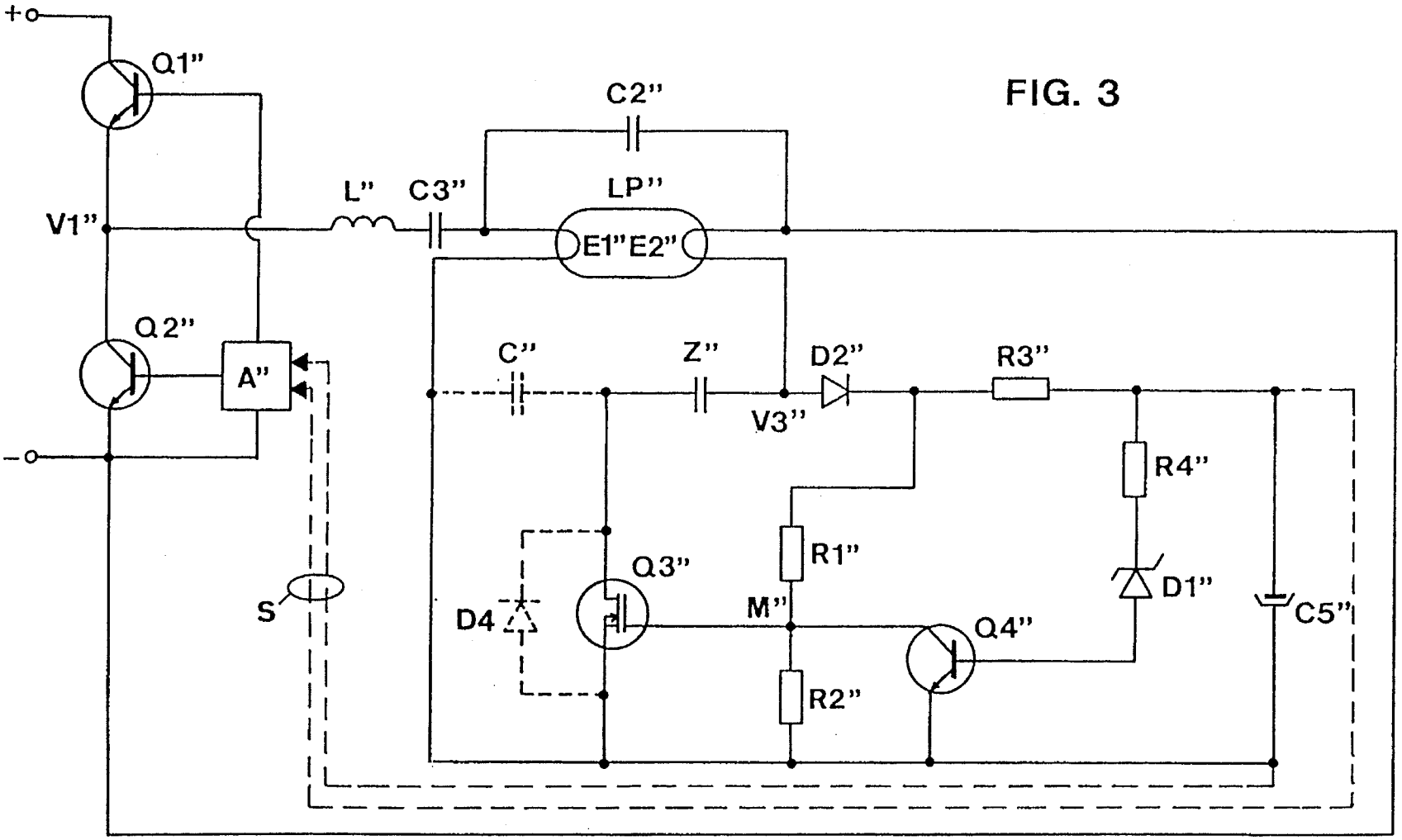
FIG. 3 is a third embodiment of a circuit, shown to operate one discharge lamp.

Referring now to FIG. 3: The circuit, as in the previous embodiments, has an inverter including two switching transistors Q1", Q2", having a mid-terminal V1", and controlled for alternate push-pull operation by a control circuit A". A series resonance circuit, formed by inductance L", a coupling capacitor C3" and a resonance capacitor C", is coupled to the mid-terminal V1" of the inverter The inductance L", for example, may be a cored inductance in the form of a lamp choke. The resonance capacitor C2" is connected to the negative terminal of the d-c supply voltage.

A low-pressure discharge lamp, for example a fluorescent lamp LP" with preheatable electrode filaments E1", E2", is connected in parallel with the resonance capacitor C2". Both lamp electrodes E1", E2" are further connected to a heating circuit for the electrodes.

In accordance with a feature of the invention, the heating circuit has a sensing impedance in form of capacitor Z" and an FET Q3". Capacitor Z" is serially connected with the drain-source path of FET Q3". The FET Q3" is controlled over a circuit which includes diode D2", connected to a tap V3" in the heater circuit, and further connected to a voltage divider R1", R2", the tap terminal M" being connected to the gate electrode of the FET Q3". As already disclosed in the prior embodiments, an R/C circuit, formed by an ohmic resistor R3" and a capacitor C5", is connected in parallel to the voltage divider R1", R2". A switching transistor Q4" has its base connected via a Zener diode D1" and a resistor R4" for control of the transistor Q4". The base emitter circuit of the transistor Q4" is connected in parallel to the capacitor C5". The emitter of transistor Q4" is connected to the negative terminal of capacitor C5" and with the lamp electrode E1". The collector of transistor Q4" is connected to the tap terminal M" of the voltage divider R1", R2" which, in turn, is connected to the gate electrode of the FET Q3". FIG. 3 also illustrates, in broken-line configuration since not absolutely necessary, a circuit to decrease the voltage loading on the FET Q3", by connecting a capacitor C" in parallel to the drain-source path of the FET Q3" to form, together with the sensing impedance capacitor Z", a capacitive voltage divider. A further diode D3 may be connected across the drain-source path of the FET Q3".

Operation, with reference to FIG. 3:

The basic operation of the embodiment of FIG. 3 is similar to that as previously described. The difference is, basically, that the rectifier GL, GL' is omitted and the FET Q3" is connected directly into the heating circuit which carries high-frequency a-c. Surprisingly, the electrode preheating circuit can operate even without the rectifier GL, GL'.

After energizing the circuit, inverter Q1", Q2" with the control circuit A" generates a high-frequency, for example 50 kHz alternating current, which energizes the series resonance circuit. The FET Q3" is turned ON or rendered conductive by receiving a gate control voltage over rectifier diode D2" and the voltage divider R1", R2". The sensing impedance, here capacitor Z", ensures that the FET Q3" receives a sufficiently high voltage, for example 10 V, applied to the voltage divider R1", R2", in order to sufficiently control the gate electrode over the resistor R2". Consequently, high-frequency heating current will flow through the lamp electrodes E1", E2".

Differing from the previous examples, FET Q3" carries alternating current. When in low-impedance or low-ohmic state of the drain source paths, the positive half-wave of the heating current is carried through the drain-source path of the FET Q3" during the electrode preheating phase, whereas the negative half-wave of the heater current is connected over the free-wheeling diode D4 connected in parallel to the drain-source path. The free-wheeling diode D4 is shown in broken lines in FIG. 3 and integrated with the FET Q3". During the preheating phase, capacitor C5" is charged over the rectifier diode D2" and the ohmic resistor R3". When the voltage on capacitor C5" reaches a threshold or critical value, Zener diode D1" becomes conductive and switches bi-polar transistor Q4" to conduction, so that the now conductive collector-emitter path of the transistor Q4" shunts resistor R2". Thus, the gate electrode of FET Q3" will lose control signal, so that its drain-source path and hence the heater current becomes of high resistance. This terminates the electrode preheating phase. Resonance capacitor C2" will build up the required ignition or arc-over voltage for the low-pressure discharge lamp LP". After ignition of the lamp LP", capacitor C5" will charge to the operating voltage of the lamp to a d-c voltage which, over resistor R4" and Zener diode D1", reliably holds the transistor Q4" in ON or conductive condition, and thus reliably blocks the FET Q3" during running operation of the lamp.

After the preheating phase is terminated, the free-wheeling diode D4, connected in parallel to the drain-source path of the FET Q3", will cause a blocking voltage to appear which corresponds roughly to the ignition or operating voltage of the lamp LP". When selecting a suitable FET Q3", therefore, one must note that it has sufficient voltage resistance to accept the ignition, or running voltage of the lamp, respectively. The voltage loading of the FET Q3" can be somewhat decreased by use of the capacitor C", shown in broken-line representation in FIG. 3, to form a capacitive voltage divider with the capacitor Z". This is not a necessary feature, and therefore, shown in broken lines.

The present invention is not limited to the embodiments above described. For example, the R/C circuit R3, C5, collectively, may, in addition to its time constant function, also take over the function of a lamp voltage monitoring unit, described in connection with FIG. 2, namely of resistor R6, R7, capacitor C6 and diode D3. In this case, the turn-off circuit within the control unit A, A', A" is monitored by the voltage drop across the capacitor C5".

A control connection, shown schematically as S across capacitor C5", illustrates the connection of such a safety turn-off circuit, coupled to the control circuit A" for the inverter transistors Q1", Q2". Of course, such a connection may also be used in the embodiment of FIG. 1, as of course the circuit coupled to the control unit A' of FIG. 2 may be used in connection with the embodiments of FIG. 1 or 3. Since the circuit is not strictly necessary, it is shown in broken lines in FIG. 3.

The Table below gives suitable values of the electrical components for the embodiment described in connection with FIG. 1 for two 58 W fluorescent lamps. Suitable components for a single lamp, in accordance with the circuits of FIG. 2 or 3, can be readily derived by using ordinary engineering knowledge.

TABLE

| | |
|---|---|
| Q1, Q2 | BUF644 |
| Q3 | BUZ80 |
| Q4 | BC547B |
| L | 1.25 mH |
| C1 | 100 pF |
| C2 | 7.5 nF |
| C3 | 200 nF |
| C5 | 2.2 μF |
| Z | 6.8 Ω |
| R1 | 240 KΩ |
| R2 | 1 MΩ |
| R3 | 480 KΩ |
| R4 | 10 KΩ |
| R5 | 2.2 KΩ |

Various other changes and modifications may be made, and any features described in connection with any one of the embodiments may be used with any of the others, within the scope of the inventive concept.

We claim:

1. Semiconductor-controlled operating circuit for at least one low-pressure discharge lamp (LP1, LP2; LP'; LP"), in which said at least one lamp has heatable lamp electrodes (E1, E2, E3, E4; E1', E2'; E1", E2"), comprising an inverter (Q1, Q2, A; Q1', Q2', A'; Q1", Q2", A") adapted to be coupled to a source of direct-current energy, and including an inverter control circuit (A, A', A");

a resonance circuit coupled to the inverter (Q1, Q2, A; Q1', Q2', A'; Q1", Q2", A") and including at least one resonance inductance (L, L', L") and a resonance capacitance (C2, C2', C2");

at least one heater circuit coupled to the heatable electrodes (E1, E2, E3, E4; E1', E2'; E1", E2") of the at least one low-pressure lamp for preheating the electrodes thereof; and a semiconductor switch (Q3, Q3', Q3") having its main switching path (drain-source) connected into the heater circuit and, in dependence on the switched state of said semiconductor switch, switching the heating circuit between a low-resistance and a high-resistance state, said operating circuit further comprising, in accordance with the invention, an impedance element (Z, Z', Z") connected in at least one of the at least one heater circuit, and in series with the main switching path of the semiconductor switch (Q3, Q3', Q3"); and a control connection between said impedance element (Z, Z', Z") and a control terminal of the semiconductor switch (Q3, Q3', Q3") for controlling said semiconductor switch in accordance with the voltage drop across the combination of the impedance element (Z, Z',Z") and the main switching path of the semiconductor switch, said impedance element (Z, Z', Z") and main switching path combination providing a voltage drop which, when the semiconductor switch is in low-resistance state, is sensed and coupled to the control terminal of the semiconductor switch to control said semiconductor switch (Q3, Q3', Q3") into low-resistance state.

2. The operating circuit of claim 1, wherein the semiconductor switch (Q3, Q3', Q3") is a field effect transistor (FET) which has its drain-source path serially connected with the impedance element (Z, Z', Z").

3. The operating circuit of claim 1, wherein the impedance element (Z) is an ohmic resistor.

4. The operating circuit of claim 3, wherein the impedance value of the impedance element (Z, Z', Z") is so selected that the voltage drop across said impedance element, in combination with the impedance of said semiconductor switch (Q3, Q3', Q3"), when in its low impedance state, is sufficient to provide a control signal which is coupled to said semiconductor switch such that said semiconductor switch will assume its low impedance value.

5. The operating circuit of claim 1, wherein the impedance element (Z', Z") is a capacitor.

6. The operating circuit of claim 5, wherein the impedance value of the impedance element (Z, Z', Z") is so selected that the voltage drop across said impedance element, in combination with the impedance of said semiconductor switch (Q3, Q3', Q3"), when in its low impedance state, is sufficient to provide a control signal which is coupled to said semiconductor switch such that said semiconductor switch will assume its low impedance value.

7. The operating circuit of claim 1, wherein the voltage drop across the series circuit comprising the impedance element (Z, Z', Z") and the main current carrying path of the semiconductor switch (Q3, Q3', Q3") is about 10 V when the main switching path of the semiconductor switch is in ON or low-resistance state.

8. The operating circuit of claim 1, further including an R/C circuit forming a timing circuit (R3, C5; R3', C5', R3", C5") establishing a predetermined time interval which is coupled to the semiconductor switch (Q3, Q3', Q3"), the timing constant of the timing circuit controlling switch-over of the semiconductor switch between ON, or low-resistance and OFF, or high-resistance state.

9. The operating circuit of claim 8, wherein the impedance value of the impedance element (Z, Z', Z") is so selected that the voltage drop across said impedance element, in combination with the impedance of said semiconductor switch (Q3, Q3', Q3"), when in its low impedance state, is sufficient to provide a control signal which is coupled to said semiconductor switch such that said semiconductor switch will assume its low impedance value.

10. The operating circuit of claim 1, wherein at least two serially connected low-pressure discharge lamps (LP1, LP2) are provided;

a transformer (TR) serially connected in a series circuit connecting one electrode each (E2, E3) of said at least two lamps through a secondary winding thereof;

and wherein the primary winding of the transformer (TR) is serially connected to said series circuit of the impedance element (Z) and the semiconductor switch (Q3).

11. The operating circuit of claim 1, wherein the impedance element (Z', Z") is a capacitor;

wherein the semiconductor switch (Q3, Q3', Q3") is a field effect transistor (FET) which has its drain-source path serially connected with the impedance element (Z, Z', Z");

and wherein the drain-source path of the field effect resistor (Q3") is directly connected in the heating circuit of the at least one low-pressure discharge lamp, said heating circuit carrying alternating current.

12. The operating circuit of claim 11, further including a capacitor (C") connected in parallel to the drain-source path of the field effect transistor (Q3") and forming a capacitive voltage divider in combination with the impedance element (Z").

13. The operating circuit of claim 1, further including a bridge rectifier (GL, GL') integrated in the heating circuit or heating circuits of the at least one low-pressure discharge lamp;

and wherein the semiconductor switch (Q3, Q3') is connected between the direct-current terminals of the bridge rectifier (GL, GL').

14. The operating circuit of claim 1, further including a lamp running voltage monitoring circuit (R6, R7, C6, D3) coupled to the at least one heating circuit of the at least one low-pressure discharge lamp or lamps, and providing a monitoring turn-OFF signal coupled to the control circuit (A, A', A") of the inverter (Q1, Q2, A; Q1', Q2', A'; Q1", Q2", A") to disable the inverter if the lamp ignition voltage or the lamp running operating voltage exceeds a predetermined limit or threshold value.

15. The operating circuit of claim 1, further including an R/C circuit forming a timing circuit (R3, C5; R3', C5', R3", C5") which is coupled to the semiconductor switch (Q3, Q3', Q3"), the timing constant of the timing circuit controlling switch-over of the semiconductor switch between ON or low-resistance and OFF or high-resistance state;

and further including a control connection between said timing circuit and the control circuit (A, A', A") for the inverter, whereby said timing circuit additionally forms a lamp ignition or running voltage monitoring circuit to control the inverter control circuit to OFF condition if the voltage across the timing circuit changes beyond a predetermined, or threshold value.

16. The operating circuit of claim 1, wherein the impedance value of the impedance element (Z, Z', Z") is so selected that the voltage drop across said impedance element, in combination with the impedance of said semiconductor switch (Q3, Q3', Q3"), when in its low impedance state, is sufficient to provide a control signal which is coupled to said semiconductor switch such that said semiconductor switch will assume its low impedance value.

* * * * *